US007497036B2

(12) United States Patent
Rhodes-Vivour

(10) Patent No.: US 7,497,036 B2
(45) **Date of Patent: *Mar. 3, 2009**

(54) VARIABLE COLOR SNEAKER LOGO AND TRIMMINGS

(76) Inventor: Temilade Stephen Rhodes-Vivour, P.O. Box 366, Ozark, AL (US) 36361

( * ) Notice: Subject to any disclaimer, the term of this patent is extended or adjusted under 35 U.S.C. 154(b) by 682 days.

This patent is subject to a terminal disclaimer.

(21) Appl. No.: 11/032,344

(22) Filed: Jan. 10, 2005

(65) Prior Publication Data

US 2005/0252044 A1 Nov. 17, 2005

Related U.S. Application Data

(60) Provisional application No. 60/570,658, filed on May 12, 2004.

(51) Int. Cl.
*A43B 23/00* (2006.01)

(52) U.S. Cl. ..... 36/136; 36/29

(58) Field of Classification Search ..... 36/132, 36/136, 100, 29, 35 B; 206/522; 446/320, 446/186, 340, 147, 180, 220
See application file for complete search history.

(56) References Cited

U.S. PATENT DOCUMENTS

| | | | | |
|---|---|---|---|---|
| 2,982,033 | A | 5/1961 | Bingham, Jr. | |
| 4,193,214 | A | 3/1980 | Wang | 36/11.5 |
| 4,292,916 | A * | 10/1981 | Bradley et al. | 116/205 |
| 4,601,727 | A | 7/1986 | Nichols, Jr. | 8/477 |
| 4,753,022 | A | 6/1988 | Gasbarro | 36/29 |
| 4,830,690 | A | 5/1989 | Cooper | 156/63 |
| 5,155,927 | A | 10/1992 | Bates et al. | 36/28 |
| 5,191,317 | A | 3/1993 | Toth et al. | 340/676 |
| 5,270,217 | A | 12/1993 | Dyke | 436/127 |
| 5,313,717 | A | 5/1994 | Allen et al. | 36/28 |
| 5,363,570 | A | 11/1994 | Allen et al. | 36/28 |
| 5,379,533 | A * | 1/1995 | Swartz | 36/136 |
| 5,493,792 | A | 2/1996 | Bates et al. | 36/28 |
| 5,718,063 | A | 2/1998 | Yamashita et al. | 36/28 |
| 5,822,888 | A | 10/1998 | Terry | 36/100 |
| 5,858,914 | A * | 1/1999 | Shibahashi et al. | 503/201 |
| 6,112,437 | A * | 9/2000 | Lovitt | 36/137 |
| 6,266,897 | B1 | 7/2001 | Seydel et al. | 36/29 |
| 6,312,782 | B1 | 11/2001 | Goldberg et al. | 428/67 |
| 6,516,540 | B2 | 2/2003 | Seydel et al. | 36/29 |
| 6,736,692 | B1 * | 5/2004 | Hoyos-Zermeno et al. | 446/296 |
| 6,775,932 | B2 * | 8/2004 | Lin | 36/136 |
| 7,080,468 | B2 | 7/2006 | Miller et al. | 36/97 |
| 7,158,276 | B1 | 1/2007 | Peng et al. | 359/265 |
| 7,262,862 | B2 | 8/2007 | Klaveness | 356/601 |
| 2002/0046476 | A1 | 4/2002 | Snyder | 36/136 |
| 2003/0087094 | A1 | 5/2003 | Smith et al. | 428/402 |
| 2003/0140999 | A1 | 7/2003 | Smith et al. | 152/524 |
| 2004/0103562 | A1 * | 6/2004 | Chaigne | 36/117.1 |
| 2007/0010400 | A1 | 1/2007 | Sabnis et al. | 504/116.1 |
| 2007/0184199 | A1 | 8/2007 | Lin | 427/407.1 |

* cited by examiner

*Primary Examiner*—Jila M Mohandesi
(74) *Attorney, Agent, or Firm*—Merchant & Gould P.C.

(57) ABSTRACT

This disclosure pertains to an apparatus for varying a footwear's color. The apparatus comprises a first variable filter having a first reservoir portion and a first non-reservoir portion. The first reservoir portion houses a first dye when the first variable filter is in a first state. The first non reservoir portion houses the first dye when the variable filter is in a second state. The apparatus further comprises a first air pouch adjacent to the first variable filter and a casing surrounding the first variable filter and the first air pouch.

21 Claims, 6 Drawing Sheets

100

VARIABLE COLOR SNEAKER LOGO AND TRIMMINGS

CROSS-REFERENCE TO RELATED APPLICATIONS

This application claims priority to U.S. Provisional Application Ser. No. 60/570,658, filed on May 12, 2004, which is hereby incorporated by reference in its entirety.

FIELD OF THE INVENTION

The present disclosure relates to footwear comprising logos and/or trimmings having at least one color that can be varied by a user.

BACKGROUND

Currently consumers are limited to one color choice for each pair of sneakers. As a result collecting footwear (e.g. sneakers) of similar styles but having different color logos and trimmings can become expensive for the consumer.

SUMMARY

This disclosure pertains to an apparatus for varying a footwear's color. The apparatus comprises a first variable filter having a first reservoir portion and a first non-reservoir portion. The first reservoir portion houses a first dye when the first variable filter is in a first state. The first non reservoir portion houses the first dye when the variable filter is in a second state. The apparatus further comprises a first air pouch adjacent to the first variable filter and a casing surrounding the first variable filter and the first air pouch.

BRIEF DESCRIPTION OF THE DRAWINGS

Non-limiting and non-exhaustive embodiments are described with reference to the following figures, wherein like reference numerals refer to like parts throughout the various views unless otherwise specified.

DETAILED DESCRIPTION

Note that throughout this specification, the terms shoe, shoes, footwear, sneaker, sneakers and other terms indicating articles to be worn on a person's feet may be used interchangeably. Varying the color of footwear can be accomplished by color subtraction. In various aspects of the present invention, two types of filters are used to vary the color of footwear, a fixed color filter and a variable color filter. The fixed color filter is fixed with respect to which colors it filters and can be made from a thin colored plastic fashioned into a shape such as the shape of a desired logo and/or trimmings. In addition, the variable color filter can be controlled such that the filter operates in varying states. A first state may be one in which the filter admits all the colors. A second state may be one in which only a single color is admitted. Note that admitting a color means light having that color is allowed to pass through the filter and filtering a color means subtracting that color light from light having combination of colors.

For example the fixed filter may filter blue light and the variable filter may filter green light. Therefore, when the variable filter is in the first state, only the fixed filter is subtracting blue light and the footwear's logo and/or trimmings would be yellow. When the variable filter is in the second state, variable filter would subtract green light and the footwear's logo and/or trimmings would be red. The color of the variable filter is determined by a dye color.

Figure 1:
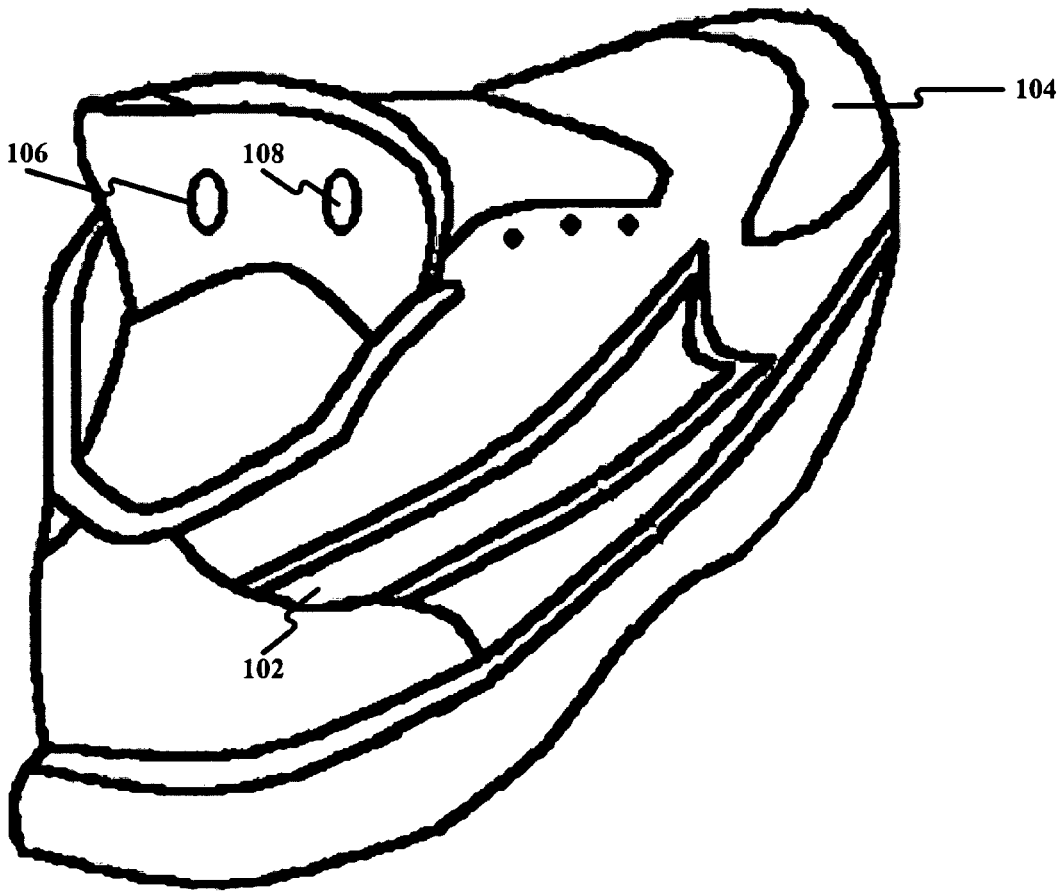
FIG. 1 shows a diagram of the variable color logo and trimming sneaker.
Figure 2:
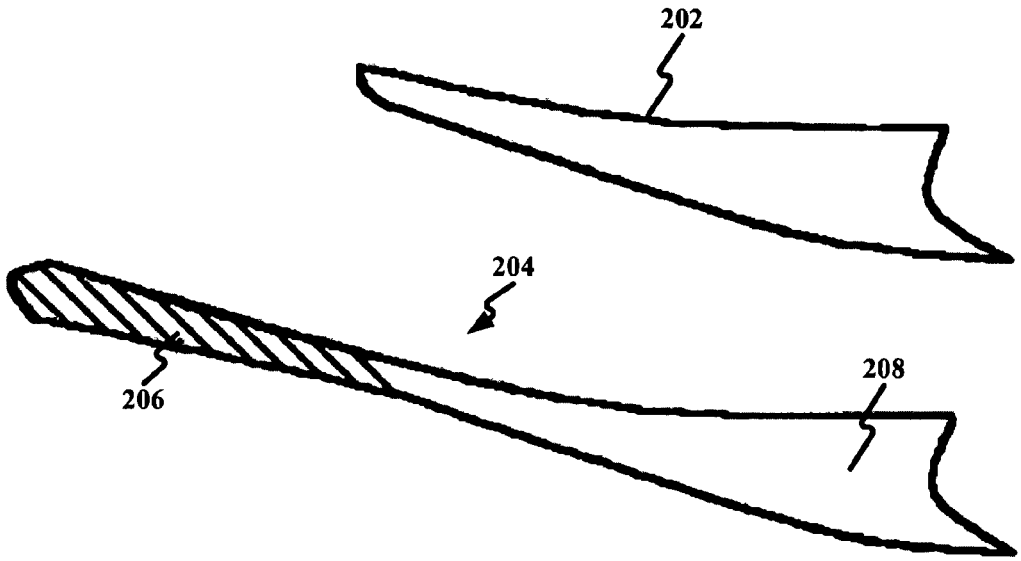
FIG. 2 shows a diagram of fixed and variable color filters.

Turning now to the figures, FIG. 1 depicts a sneaker 100 fitted with a color changing logo 102 and color changing trimmings 104. Openings 106 and 108 are used to vary the color of logos 102 and 104. FIG. 2 shows a fixed filter 202 and a variable filter 204. In various embodiments of the invention, fix filter 202's thickness should be no greater than 1 mm. Variable filter 204 can be controlled by an applied force to a reservoir portion 206. This force can be pneumatic.

Variable filter 204 can be made from a thin colorless transparent plastic. In fabricating variable filter 204 two plastic sheets can be placed together and then heat stamped in a desired shape. One end of variable filter 204 should be left unsealed for the purpose of filling it with a dye having the desired color for color subtraction. Enough liquid dye should be added so that a thin layer of the dye fills non-reservoir portion 208. Reservoir portion 206 of variable filter 204 is denoted by the hatched area. After filling variable filter 204 with an appropriate amount of dye, variable filter 204's open end can then be heat sealed so that the dye is confined within variable filter 204. The same fabrication process can be used to fabricate variable filters for trimmings. In various aspects of the invention, variable filter 204's thickness should be no greater than 1 mm.

Figure 3:
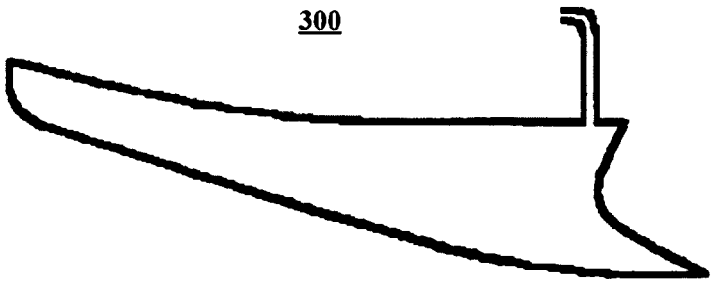
FIG. 3 shows a side view diagram of inner and outer air pouches.

FIG. 3 shows the front view of an air pouch 300. Air pouch 300 can be fashioned in the shape of the desired logo and/or trimmings and are made from two different grades of plastic. One of the plastic grades is comparable to that used in variable filter 204's fabrication. The second plastic is of a higher grade plastic than the first plastic. Heat sealing methods used in fabricating variable filter 204 can be used to fabricate air pouch 300. The two different grades of plastic used in fabricating air pouch 300 are used because one side air pouch 300 is inflated by internal air pressure. The side of air pouch 300 made from the lower grade plastic is more responsive to internal pressure changes. It is this more responsive plastic that is placed in direct contact with variable filter 204. Placing the more responsive plastic in contact with variable filter 204 isolates the influence air pouch 300 to variable color filter 204.

Figure 4:
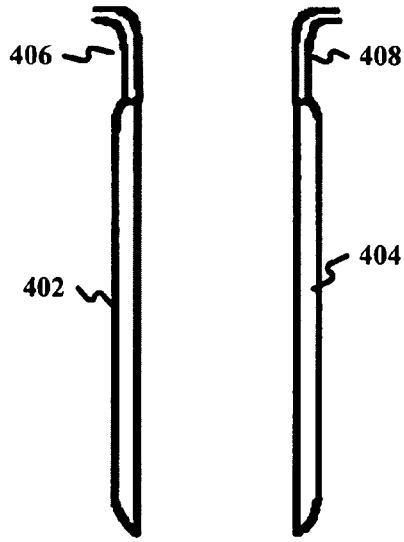
FIG. 4 shows a front view diagram of outer air pouch.

Consistent with various embodiments of the invention, there are two types of air pouches can be used, both of which are identical in all aspects except for the side of the air pouch that is allowed to inflate. FIG. 4 depicts both types of air pouches. An inner air pouch 402 inflates on the side facing toward the footwear surface. An outer air pouch 404 inflates on the side facing away from the footwear surface. Air pouches 402 and 404 should have a thickness no greater than 1 mm. In addition, air pouches 402 and 404 comprise air lines 406 and 408. Air lines 406 and 408 are be connected to air pouches 402 and 404 in a manner that ensures that there will be no pressure leaks.

The operation of variable filter 204 in conjunction with and associated air pouch is as follows: if the air pouch is not inflated (i.e. empty), the dye contained in variable filter 204 is unperturbed and remains in non-reservoir region 208 (i.e. a non-active condition). If the air pouch is inflated (i.e. full of air), the air pressure forces the dye in variable filter 204 into the reservoir 206 (i.e. an active condition). Any footwear component layer adjacent to variable filter 204 acts as a supporting force which compliments the air pouch's effect on variable filter 204. The dye, now in non-reservoir region 208 established the footwear's color.

Figure 5:
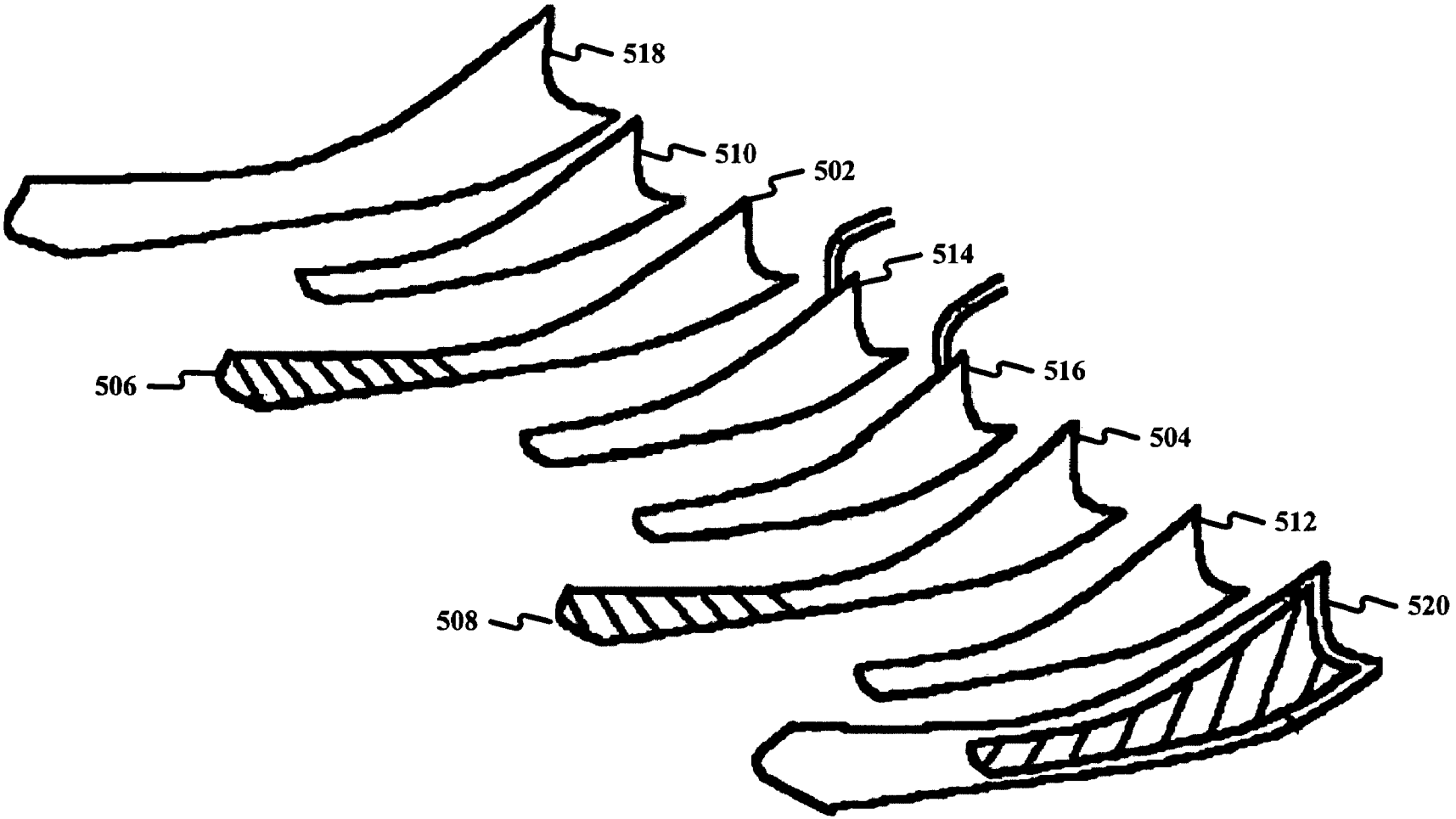
FIG. 5 shows a diagram of the exploded view of the variable color logo.

FIG. 5 gives an exploded view of various components of color changing logo materials. In FIG. 5 there are two variable filters 502 and 504, two fixed filter 510, backing 512, air pouches 514 and 516 and casings 518 and 520. Each variable filter 502 and 504 can filter different wavelengths (i.e. colors of light). For example, variable filter 502 can permit light having a wavelength corresponding to cyan to pass while variable filter 504 can permit light having a wavelength corresponding to yellow to pass. The hatched regions denoted by reference numerals 506 and 508 represent the reservoirs of variable filters 502 and 504, respectively. Backing 512 may be any color (e.g. white) and/or may be a white piece of plastic or paper that is cut in the shape of the desired logo and/or trimmings. Backing 512 can act as a reflector to reflect incident light back to an observer. The thickness of backing 512 should be no greater than 1 mm.

Figure 6:
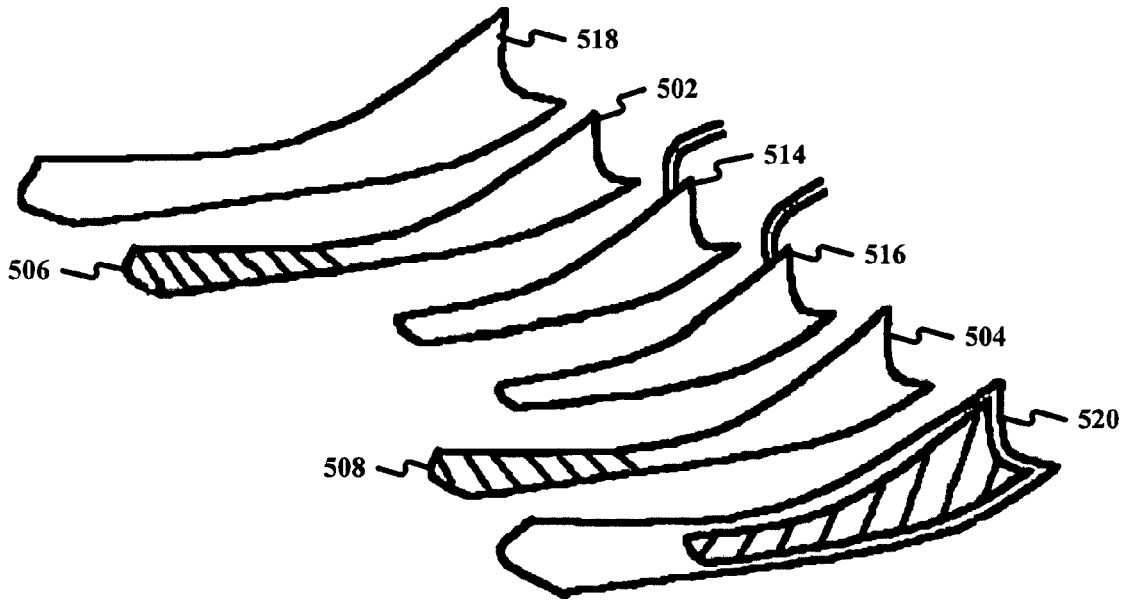
FIG. 6 shows a diagram showing alternate exploded view of variable color logo.

FIG. 6 shows an alternative to using backing 512. This alternative is to paint the rear side of variable filter 502 or 504 a color (e.g. white). Painting variable filter 502's or 504's rear side can eliminate the need for a separate layer to perform color reflection. This same alternate configuration can be used to eliminate the need for a fixed color filter layer. In order to implement this alternate configuration, variable filter 502's rear side can be painted the same color as the removed fixed filter.

As shown in FIG. 5, the active layers of the variable color logo 102 are sandwiched between two pieces of sturdy, high-grade plastic (e.g. casing 518 and 520). Active layers are all the components lying between the casing 518 and 520. Casings 518 and 520 act as a protective casing. Casing 520 must be transparent while the transparency of the back side is irrelevant. The perimeter of casings 518 and 520 should be greater than the perimeter of the active layers.

Figure 7:
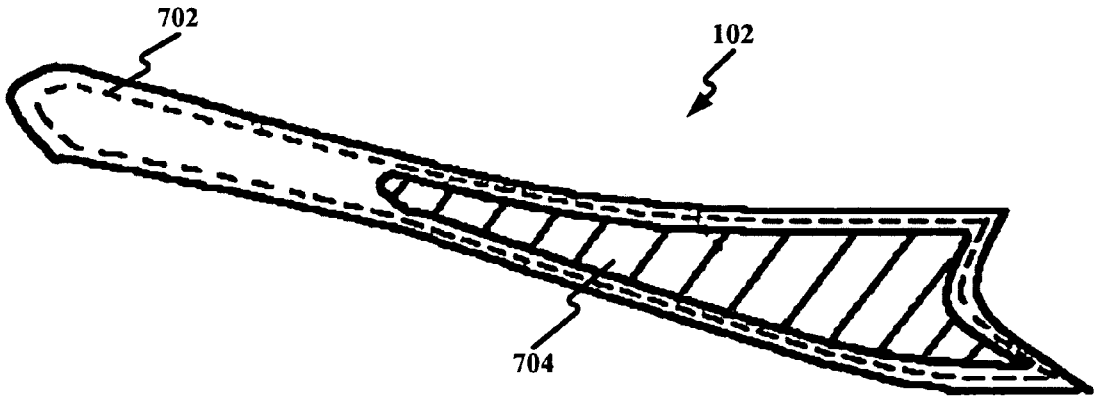
FIG. 7 shows a diagram of assembled variable color logo.

Casings 518 and 520 can be attached to one another by stitch or adhesive. The advantage of attaching casings 518 and 520 by stitch is that the attachment to a sneaker can be accomplished simultaneously. The assembled variable color logo 102 is shown in FIG. 7. FIG. 7 shows the stitching of the variable color logo 102. This stitching is denoted by reference numeral 702. The hatched region denoted by reference number 704 represents the area of variable color logo 102 that changes color. The area around region 704 can be painted the same color as the sneaker. The composition and fabrication of the color changing trimming material is analogous to the previously mentioned composition and fabrication methods of the color changing logo material.

The example described above in regards to FIG. 5 describes a color combination of magenta, yellow and cyan. This color combination provides four possible color options for the logo and/or trimming material: 1) pink; 2) red; 3) blue; and 4) black. These color options are determined by use of color perception theory. For example, 1) the combination of magenta (pink) and yellow equals red. The combination of pink and cyan equals blue and the combination of pink, yellow and cyan add to give black. Finally the absence of yellow and cyan leaves pink. The filter color combination can be set arbitrarily so as to provide the desired logo and/or trimming color options.

Figure 8:
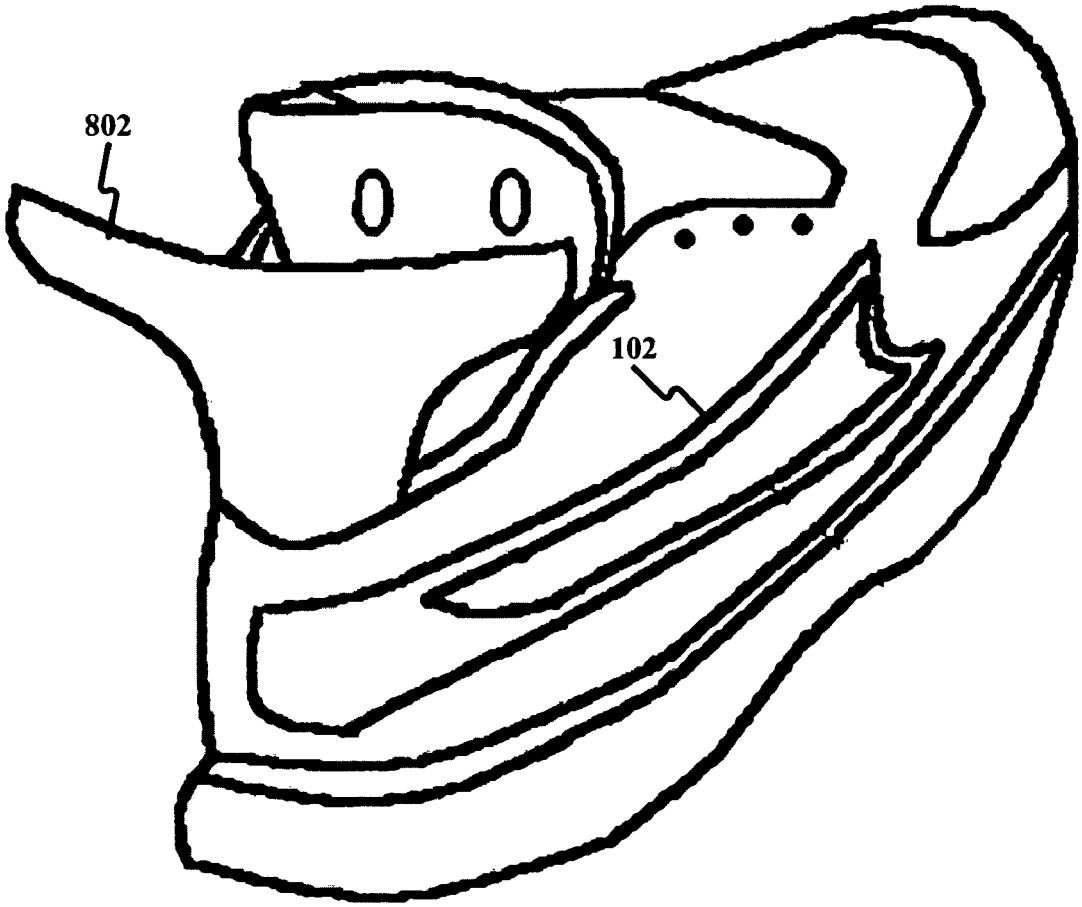
FIG. 8 shows a diagram showing the attachment of the variable color logo.

After variable color logo 102 has been assembled it can then be attached to sneaker 100. FIG. 8 gives a graphic depiction of this attachment. The leather flap 802 has been shown lifted for clarity. Next, variable color logo 102 is attached to sneaker 100 and leather flap 802 is lowered back into place. Finally, leather flap 802 is either stitched or glued to sneaker 100.

Figure 9:
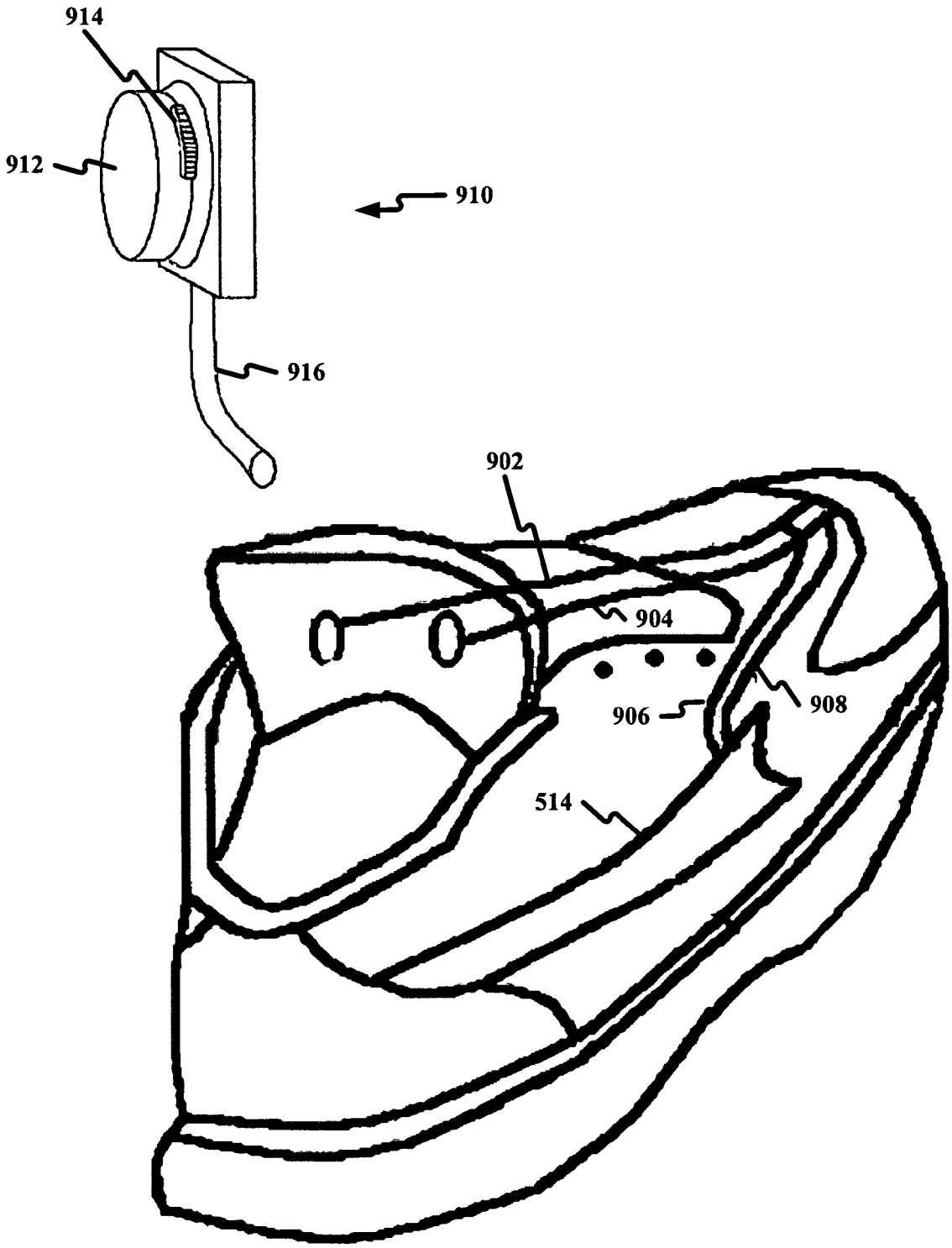
FIG. 9 shows a diagram of the sneaker pump system.

The air pouches are inflated by a pump system 900 shown in FIG. 9. Pump system 900 includes air pouch 514 (air pouch 516 is not shown), air lines 902, 904, 906, and 908 and a pump mechanism 910. Air lines 902 and 906 correspond to air pouch 514. Air lines 904 and 908 correspond to their respective air pouches in the color changing trimming. Air lines 902, 904, 906, and 908 should be placed so as to provide minimum intrusion. It is recommended that they be placed within the shoe lining.

Pump 910 is composed of three basic parts: a pump bulb 912, a pressure release valve 914, and an air line 916. Pump 910 should be fabricated to be as small as possible and placed on the inner side of the shoe tongue so as to be relatively non-intrusive. The exact specifications for pump 910 are left to the discretion of a manufacturer. The only stipulation for pump 910 is that it be discrete, non-bulky, and pressure release valve 914 should be placed on or near pump bulb 912.

The number of pumps needed is dependent on the desired number of distinct logo and/or trimming colors. For example, in order to produce four distinct colors you need two pumps, one for each of the two variable filters. Two colors are a result of the fixed filters and the combined effect of both the fixed filter and the variable filters. An increase in color options coincides proportionately with an increase in system complexity.

For operation of embodiments of the present invention, assume there are four distinct color options (i.e. there are two variable filters, two fixed filters, and two pumps). With two pumps the variable filters can operate independently of each other. For an initial condition, assume both variables filters' air pouches are not inflated. The logo's trimming's apparent color is approximately black. A next possible state occurs when one of the pumps is activated. This causes an air pouch to inflate which in turn forces the dye in a variable filter into a reservoir labeled, thus leaving the non-reservoir portion. As a result, the variable filter no longer acts as a color filter, but instead, allows all colors to pass. Now only one variable filter and a fixed filter remain to indicate a color. The combination of these filters causes the logo and trimming's color to appear a certain color (e.g. red).

A next possible state for this system occurs when the previously applied pressure is released and the second pump is activated. The release of the pressure of the first pump causes the previously inflated air pouch to deflate, which returns the filter to its original state (i.e. the shoe its original color). The activation of the second pump inflates a second air pouch and as a result dye in the second variable filter is forced into its reservoir leaving the non-reservoir area. Thus, the remaining filters (the variable color filter and the fixed filters) add to give the logo and trimming a second color (e.g. blue).

A fourth state of this system occurs when both pumps are activated. As a result, the dye in both variable filters are contained in their respective reservoirs and the non-reservoir areas of both variable color filters are left empty. This condition gives the logo and trimming a third color (e.g. pink). As previously mentioned, these color combinations are only one of many possible color combinations. Using different color filters will result in a separate set of color options for the logo and trimming.

Reference may be made throughout this specification to "one embodiment," "an embodiment," "embodiments," "an aspect," or "aspects" meaning that a particular described feature, structure, or characteristic may be included in at least one embodiment of the present invention. Thus, usage of such phrases may refer to more than just one embodiment or aspect. In addition, the described features, structures, or characteristics may be combined in any suitable manner in one or more embodiments or aspects. Furthermore, reference to a single item may mean a single item or a plurality of items, just as reference to a plurality of items may mean a single item. Moreover, use of the term "and" when incorporated into a list is intended to imply that all the elements of the list, a single item of the list, or any combination of items in the list has been contemplated.

One skilled in the relevant art may recognize, however, that the invention may be practiced without one or more of the specific details, or with other methods, resources, materials, etc. In other instances, well known structures, resources, or operations have not been shown or described in detail merely to avoid obscuring aspects of the invention.

While example embodiments and applications of the present invention have been illustrated and described, it is to be understood that the invention is not limited to the precise configuration and resources described above. Various modifications, changes, and variations apparent to those skilled in the art may be made in the arrangement, operation, and details of the methods and systems of the present invention disclosed herein without departing from the scope of the claimed invention.

The above specification, examples and data provide a description of the manufacture and use of the invention. Since many embodiments of the invention can be made without departing from the spirit and scope of the invention, the invention resides in the claims hereinafter appended.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

I claim:

1. A footwear comprising an apparatus for varying the footwear's color, the apparatus comprising:

a first variable filter having a first reservoir portion housing a first dye when the first variable filter is in a first state and a first non-reservoir portion housing the first dye when the variable filter is in a second state, wherein the first reservoir portion having a configuration so that the first reservoir portion is not visible;

a first air pouch adjacent to the first variable filter and not in fluid communication with the first variable filter; and a casing surrounding the first variable filter and the first air pouch.

2. The apparatus of claim 1 further comprising a first fixed filter located adjacent to the first variable filter.

3. The apparatus of claim 1, wherein a side of the first variable filter is painted.

4. The apparatus of claim 1 further comprising a reflector located adjacent to the first variable filter.

5. The footwear of claim 1 further comprising a pump operatively connected to the first air pouch.

6. The apparatus of claim 1 further comprising a second variable filter having a second reservoir portion housing a second dye when the second variable filter is in a first state and a second non-reservoir portion housing the second dye when the second variable filter is in a second position.

7. The apparatus of claim 6, wherein a side of the second variable filter is painted.

8. The apparatus of claim 6 further comprising a pump operatively connected to the first air pouch and the second air pouch.

9. The apparatus of claim 6 further comprising a second fixed filter located adjacent to the second variable filter.

10. The apparatus of claim 6 further comprising a second reflector located adjacent to the second variable filter.

11. The apparatus of claim 1, wherein the casing is sewn to the footwear.

12. The apparatus of claim 1, wherein the casing is attached to the footwear with an adhesive.

13. A method for varying footwear's color, the method comprising:

passing a first dye from a first reservoir portion to a first non-reservoir portion of a first variable filter, attached to a footwear, wherein the first reservoir portion having a configuration so that the first reservoir portion is not visible, wherein passing the first dye from the first reservoir portion to the first non-reservoir portion comprises inflating a first air pouch, wherein the first air pouch is not in fluid communication with the first variable filter.

14. The method of claim 13 further comprising locating a first fixed filter adjacent to the first variable filter.

15. The method of claim 13 further comprising passing a second dye from a second reservoir portion to a second non-reservoir portion of a second variable filter, wherein passing the second dye from the second reservoir portion to the second non-reservoir portion comprises inflating a second air pouch.

16. The method of claim 15 further comprising locating a second fixed filter adjacent to the first variable filter.

17. A sneaker comprising:

a first variable filter having a first reservoir portion housing a first dye when the first variable filter is in a first state and a first non-reservoir portion housing the first dye when the variable filter is in a second state, wherein the first reservoir portion having a configuration so that the first reservoir portion is not visible;

a first air pouch adjacent to the first variable filter and not in fluid communication with the first variable filter;

a first fixed filter located adjacent to the first variable filter;

a casing surrounding the first variable filter, the first air pouch and the first fixed filter; and a pump having a release valve, the pump fluidly connected to the first air pouch.

18. The sneaker of claim 17 further comprising:

a second variable filter having a second reservoir portion housing a second dye when the second variable filter is in a first state and a second non-reservoir portion housing the second dye when the second variable filter is in a second position; and a second fixed filter located adjacent to the second variable filter.

19. The sneaker of claim 17, wherein a side of the first variable filter is painted.

20. The sneaker of claim 17 further comprising a reflector located adjacent to the first variable filter or the first fixed filter.

21. A sneaker comprising:

a first variable filter having a first reservoir portion concealed from sight by a portion of the sneaker, the first variable filter housing a first dye when the first variable filter is in a first state and a first non-reservoir portion housing the first dye when the variable filter is in a second state;

a first air pouch adjacent to the first variable filter and not in fluid communication with the first variable filter; and a reflector located adjacent to the first variable filter.

* * * * *